US007509707B2

(12) United States Patent
Pullins

(10) Patent No.: US 7,509,707 B2
(45) Date of Patent: Mar. 31, 2009

(54) FLOOR CLEANING APPARATUS WITH DIRT DETECTION SENSOR

(75) Inventor: Alan T. Pullins, Richmond, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 497 days.

(21) Appl. No.: 11/347,865

(22) Filed: Feb. 6, 2006

(65) Prior Publication Data

US 2007/0180649 A1 Aug. 9, 2007

(51) Int. Cl.
*A47L 5/00* (2006.01)

(52) U.S. Cl. ..... 15/339; 15/DIG. 11

(58) Field of Classification Search ..... 15/319, 15/339, DIG. 11; *A47L 5/00, 7/00*
See application file for complete search history.

(56) References Cited

U.S. PATENT DOCUMENTS 4,601,082 A 7/1986 Kurz
4,680,827 A 7/1987 Hummel
4,920,605 A 5/1990 Takashima
4,942,640 A 7/1990 Hayashi et al.
5,134,749 A * 8/1992 Sakurai et al. ..... 15/325
5,144,715 A 9/1992 Matsuyo et al.
5,152,028 A 10/1992 Hirano
5,182,833 A 2/1993 Yamaguchi et al.
5,216,777 A 6/1993 Moro et al.
5,233,682 A 8/1993 Abe et al.
5,251,358 A 10/1993 Moro et al.
5,323,483 A 6/1994 Baeg
5,539,953 A 7/1996 Kurz
5,542,146 A 8/1996 Hoekstra et al.
5,613,261 A 3/1997 Kawakami et al.
6,323,570 B1 11/2001 Nishimura et al.
6,400,048 B1 6/2002 Nishimura et al.
6,437,465 B1 8/2002 Nishimura et al.
6,910,245 B2 * 6/2005 Hawkins et al. ..... 15/339
2004/0177467 A1 9/2004 Jones et al.

* cited by examiner

*Primary Examiner*—David A Redding
(74) *Attorney, Agent, or Firm*—King & Schickli, PLLC

(57) ABSTRACT

A vacuum cleaner includes a housing that carries a suction inlet, a dirt collection vessel, a main filter compartment and a suction generator. The main filter is received in the main filter compartment. An airflow pathway connects the suction inlet, the dirt collection vessel, the main filter compartment and the suction generator. A dirt detection sensor is provided in the airflow pathway between the dirt collection vessel and the main filter compartment.

18 Claims, 1 Drawing Sheet

CONTROLLER
19
17
60
62
10
59
28
54
14
46
26
56
32
30
58
22
24
36
40
38
12
52
64
34
50
66
36
68
48
18
70
42
44
16
15
20
15

FLOOR CLEANING APPARATUS WITH DIRT DETECTION SENSOR

TECHNICAL FIELD

The present invention relates generally to the floor care appliance field and, more particularly, to a vacuum cleaner equipped with a dirt collection vessel, a main filter compartment and a dirt detection sensor.

BACKGROUND OF THE INVENTION

A vacuum cleaner is an electrically powered, mechanical appliance utilized for the dry removal of dust and loose dirt from carpets, rugs, fabrics and other surfaces. Vacuum cleaners have been widely used for years in domestic and industrial cleaning applications.

In operation, a pressure drop is utilized to force air entrained with loose dirt and debris into the nozzle of the vacuum cleaner. The dirt and debris laden air is then drawn through a filter bag or dirt cup that traps and retains the dirt. The air is then exhausted by electric fan through an additional filter to remove relatively fine particles such as carbon particles from the brushes of the fan motor. It is this fan that provides the air pressure drop or vacuum that provides the cleaning action. The present invention relates to a vacuum cleaner equipped with a dirt collection vessel and a separate main filter compartment. A dirt detection sensor is provided in the airflow pathway between the dirt collection vessel and the main filter compartment. Indicator lamps indicate when the dirt collection vessel should be emptied and/or the main filter changed.

SUMMARY OF THE INVENTION

In accordance with the purposes of the present invention as described herein, an improved vacuum cleaner is provided. That vacuum cleaner comprises a housing that carries a suction inlet, a dirt collection vessel, a main filter compartment separate from the dirt collection vessel and a suction generator. The main filter is received in the main filter compartment. An airflow pathway connects the suction inlet, the dirt collection vessel, the main filter compartment and the suction generator. A sensor for detecting dirt is provided in the airflow pathway between the dirt collection vessel and the main filter compartment.

In one possible embodiment, the dirt collection vessel comprises a dirt cup having a dirt collection chamber. The dirt collection chamber is substantially cylindrical in shape. In addition the dirt cup includes a tangentially directed inlet and an axially directed outlet. These structural features combine to produce cyclonic airflow within the dirt collection chamber. That airflow functions to more efficiently remove dirt and debris from the airstream being drawn through the vacuum cleaner.

The dirt collection vessel may also optionally include a partition having a frustoconical shape. Such a partition functions to further enhance cyclonic airflow within the dirt collection chamber to thereby provide high cleaning efficiency. A screen may also be provided covering the axially directed outlet in order to insure that relatively large particles of dirt and debris are captured in the dirt collection chamber.

The main filter compartment includes a main filter retainer for holding the main filter. The main filter may take the form of a cartridge including a filter housing that holds a filtering material. The main filter compartment may also include a removable access door. Such a door allows the operator to open the main filter compartment and thereby access the main filter for cleaning and/or changing.

The dirt detection sensor includes a first indicator that is activated upon the sensor detecting a first predetermined level of dirt passing through the airflow pathway. This first indicator advises an operator to empty the dirt collection vessel. The dirt detection sensor also includes a second indicator that may, for example, be activated after a predetermined period of operation or after a predetermined number of first indicator activations in order to advise the operator to change or clean the main filter. The indicators may take the form of indicator lamps and/or audio signal producers.

In accordance with additional aspects of the present invention the housing includes a nozzle assembly and a canister assembly. A rotary agitator may be carried on the nozzle assembly adjacent the suction inlet. Further the canister assembly may be pivotally connected to the nozzle assembly.

In still yet another possible embodiment the airflow pathway includes a wand positioned between the suction inlet and the dirt collection vessel. Further a secondary filter may be provided in the airflow pathway upstream from the suction generator and downstream from the main filter. In addition, the vacuum cleaner may include a final filter in the airflow pathway downstream from the suction generator.

In accordance with yet another aspect of the present invention a method of manufacturing a vacuum cleaner is provided. The method includes the steps of (a) providing the vacuum cleaner with a dirt collection vessel and a separate main filter compartment and (b) providing a dirt detection sensor in an airflow pathway between the dirt collection vessel and the main filter compartment.

In the following description there is shown and described a preferred embodiment of this invention simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of this specification, illustrates several aspects of the present invention, and together with the description serves to explain certain principles of the invention. In the drawing.

Figure 1:
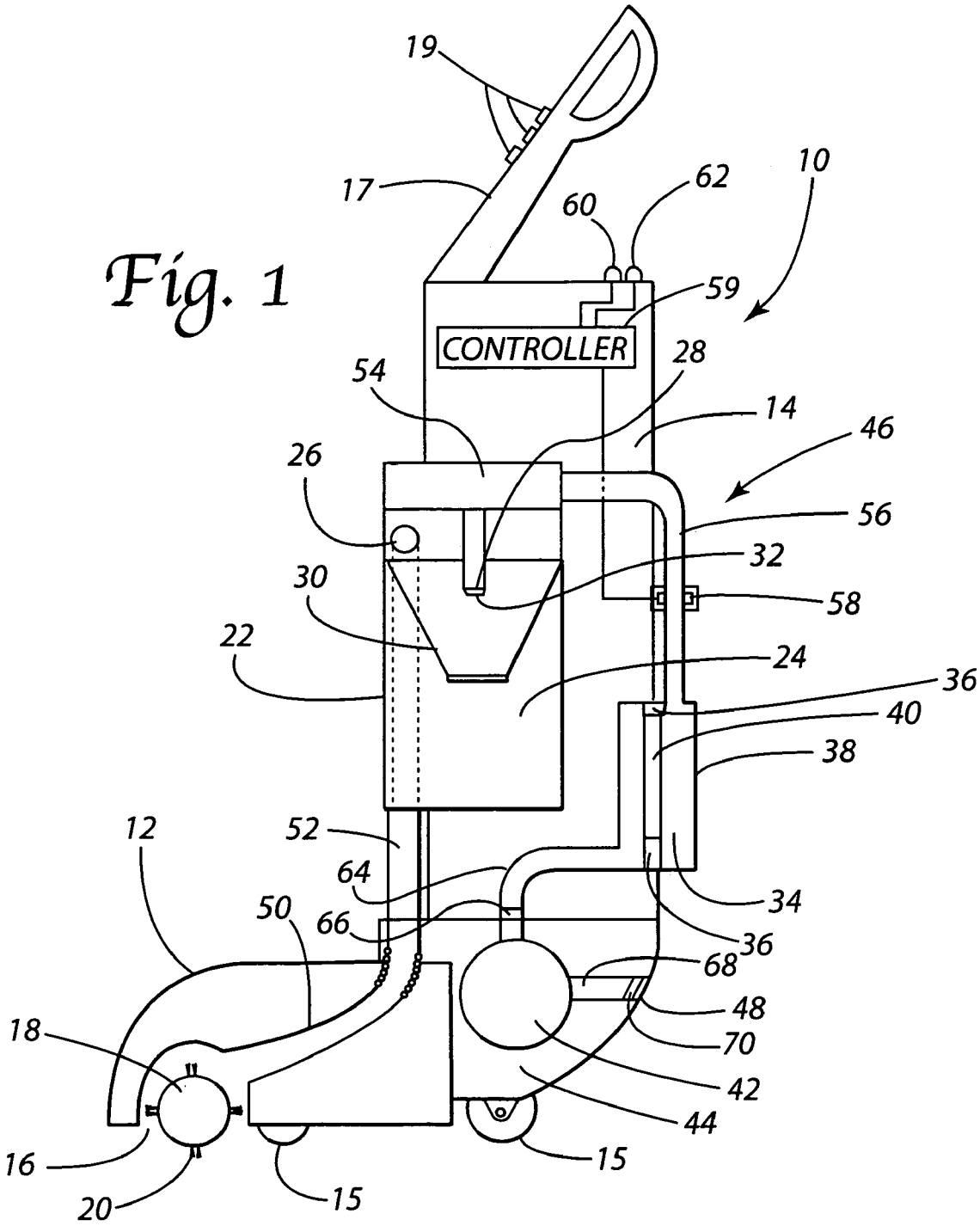
FIG. 1 is a schematical view illustrating the airflow pathway through the vacuum cleaner of the present invention.

Reference will now be made in detail to the present preferred embodiment of the invention, an example of which is illustrated in the accompanying drawing.

DETAILED DESCRIPTION OF THE INVENTION

As illustrated in FIG. 1, the present invention may take the form of an upright vacuum cleaner 10 including a housing comprising both a nozzle assembly 12 and a canister assembly 14. The canister assembly 14 is pivotally connected to the nozzle assembly 12. The upright vacuum cleaner 10 rides over the floor surface being cleaned on wheels 15 carried on the housing.

The nozzle assembly 12 includes a suction inlet 16. A rotary agitator 18 carried on the nozzle assembly 12 is mounted adjacent to or in the suction inlet 16. The rotary agitator 18 includes bristle tufts 20, brushes, wipers or the like to beat dirt and debris from the nap of an underlying carpet being cleaned as the agitator is rotated at high speeds with respect to that carpet and the nozzle assembly 12.

The canister assembly 14 includes a control handle 17 that carries conveniently located switches 19 for controlling the operation of the vacuum cleaner 10. A dirt collection vessel 22 is carried in a receiver or internal cavity on the canister assembly 14. In the illustrated embodiment, the dirt collection vessel 22 takes the form of a dirt cup having a dirt collection chamber 24. The dirt collection chamber 24 is cylindrical in shape. The dirt cup 22 includes a tangentially directed air inlet 26 and an axially directed air outlet 28 in fluid communication with the dirt collection chamber 24. Such a structural arrangement promotes cyclonic airflow in the dirt collection chamber 24. As is known in the art, cyclonic airflow functions to efficiently separate the majority of the dirt and debris from the airstream. A partition 30 of frustoconical shape may be provided in the dirt collection chamber 24, if desired, in order to promote smooth cyclonic airflow and further enhance cleaning efficiency. A screen 32 may be provided over the end of the axially directed air outlet 28 in order to insure that all but the finest dirt and debris is trapped in the dirt collection chamber 24.

As further illustrated, a separate main filter compartment 34 is carried on the canister assembly 14. The main filter compartment 34 includes a retainer 36 (such as a cavity that is sized and shaped to receive the filter 40 with a friction fit) and a removable access door 38. The retainer 36 functions to hold a main filter 40 which, for example, may take the form of a cartridge incorporating a frame for holding a filter material of a type well known in the art. The access door 38 may be open to allow access to the interior of the main filter compartment 34 so that the operator may clean or change the main filter 40.

As further illustrated in FIG. 1, a suction generator 42 is held in a fan compartment 44 provided on the canister assembly 14. An airflow pathway, generally designated by reference numeral 46 provides a fluid connection between the suction inlet 16 and the tangentially directed inlet 26 of the dirt collection vessel 22, between the outlet 28 and the main filter compartment 34, between the main filter compartment and the suction generator 42 and between the suction generator and the exhaust port 48.

The portion of the airflow pathway 46 between the suction inlet 16 and the tangential inlet 24 of the dirt collection vessel 22 includes a conduit 50 in the nozzle assembly 12 and the canister assembly 14, a removable wand 52 and a flexible hose (not shown) extending between the removable wand 52 and the inlet 24. When the distal end of the wand 52 is removed from the nozzle assembly 14, the operator may manipulate the wand to clean above the floor or in tight spaces where the nozzle assembly 12 cannot be used to provide the desired cleaning.

The airflow pathway 46 between the axial outlet 26 of the dirt collection vessel and the main filter compartment 34 comprises an exhaust manifold 54 and a conduit 56. A dirt detection sensor 58 is provided along the airflow pathway 46 between the dirt collection vessel 22 and the main filter compartment 34. In the illustrated embodiment the sensor 58 is provided in or along the conduit 56.

The sensor 58 may comprise any dirt detection sensor of a type known in the art to be useful in detecting dirt particles traveling in the airflow path of a vacuum cleaner. The sensor detects dirt and debris passing through the conduit 56 between the dirt collection vessel 22 and the main filter compartment 34. The sensor 58 produces a control signal proportional to the amount of dirt and debris detected in the airstream. That signal is sent to a controller 59. The controller 59 compares the amount of dirt and debris detected by the sensor 58 to a predetermined value. When the amount of dirt detected reaches or exceeds that predetermined value, the controller 59 activates a first indicator 60 which may, for example, take the form of an LED lamp and/or an audio producer such as a piezoelectric buzzer. The activation of the first indicator 60 provides notice to the operator that it is time to cease vacuum cleaner operation and empty the dirt and debris collected in the dirt collection vessel 22. The dirt collection vessel 22 may then be reinstalled in the canister assembly 14 and vacuum cleaner operation may then be reinitiated.

After a predetermined number of operating cycles in which the first indicator 60 is activated to notice the need to empty the dirt collection vessel 22 or after a predetermined period of vacuum cleaner operation, the controller 59 activates a second indicator 62. The second indicator 62, like the first indicator 60, may take the form of an LED lamp or an audio producer. When the second indicator 62 is activated, the operator is alerted to the need to clean or change the main filter 40 in the main filter compartment 34. This is accomplished by turning off the vacuum cleaner, opening the access door 38 and removing the main filter 40 from the retainer 36. The main filter 40 is then cleaned and returned to the retainer 36 or replaced with a new filter. The access door 38 is then closed and the vacuum cleaner is once again ready for operation.

The indicators 60, 62 may be resettable either manually or automatically. For example, sensors may be provided to detect emptying of the dirt collection vessel 22 and removal and replacement of the main filter 40.

The airflow pathway 46 also includes a conduit 64 extending from the main filter compartment 34 to the inlet to the suction generator 42. If desired, a secondary filter 66 may be provided in the conduit 64 between the main filter compartment 34 and the suction generator 42. In addition, the airflow pathway 46 includes a conduit 68 extending from the outlet of the suction generator 42 to the exhaust manifold 54. A final filter 70 such as a HEPA filter may be provided in this conduit 68 to filter any fine particles remaining in the airstream including, for example, carbon particles from the brushes of the motor that drives the suction generator 42.

The foregoing description of a preferred embodiment of the present invention has been presented for purposes of illustration and description. It is not intended to be exhaustive or to limit the invention to the precise form disclosed. Obvious modifications or variations are possible in light of the above teachings.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims and their fair and broad interpretation in any way.

What is claimed:

1. A vacuum cleaner, comprising:

a housing;

a suction inlet carried on said housing;

a dirt collection vessel carried on said housing;

a main filter compartment carried on said housing;

a main filter received in said main filter compartment;

a suction generator carried on said housing;

an airflow pathway connecting said suction inlet, said dirt collection vessel, said main filter compartment and said suction generator; and a sensor for detecting dirt in said airflow pathway between said dirt collection vessel and said main filter compartment.

2. The vacuum cleaner of claim 1, wherein said dirt collection vessel comprises a dirt cup having a dirt collection chamber.

3. The vacuum cleaner of claim 2, wherein said dirt collection chamber is substantially cylindrical in shape and said dirt cup includes a tangentially directed inlet and an axially directed outlet.

4. The vacuum cleaner of claim 3, wherein said dirt cup includes a partition having a frustoconical shape.

5. The vacuum cleaner of claim 4, further including a screen covering said axially directed outlet.

6. The vacuum cleaner of claim 1, wherein said main filter is a cartridge including a filter housing holding a filtering material.

7. The vacuum cleaner of claim 1, wherein said main filter compartment includes a main filter retainer and an openable access door.

8. The vacuum cleaner of claim 1, wherein said sensor includes a first indicator that is activated upon said sensor detecting a first predetermined level of dirt in said airflow pathway and advises an operator to empty said dirt collection vessel.

9. The vacuum cleaner of claim 8, wherein said sensor includes a second indicator that is activated to advise an operator to clean or change said main filter.

10. The vacuum cleaner of claim 9, wherein said first indicator and said second indicator are indicator lamps.

11. The vacuum cleaner of claim 9, wherein said first indicator and said second indicator are audio signal producers.

12. The vacuum cleaner of claim 1, wherein said housing includes a nozzle assembly and a canister assembly.

13. The vacuum cleaner of claim 12, further including a rotary agitator carried on said nozzle assembly adjacent said suction inlet.

14. The vacuum cleaner of claim 13, wherein said canister assembly is pivotally connected to said nozzle assembly.

15. The vacuum cleaner of claim 1, wherein said airflow pathway includes a wand positioned between said suction inlet and said dirt collection vessel.

16. The vacuum cleaner of claim 1, further including a secondary filter in said airflow pathway upstream from said suction generator and downstream from said main filter.

17. The vacuum cleaner of claim 1, further including a final filter in said airflow pathway downstream from said suction generator.

18. A method of manufacturing a vacuum cleaner, comprising:

providing the vacuum cleaner with a dirt collection vessel and a separate main filter compartment; and providing a dirt detection sensor in an airflow pathway between said dirt collection vessel and said main filter compartment.

* * * * *